US006626514B2

(12) United States Patent
Tajima et al.

(10) Patent No.: US 6,626,514 B2
(45) Date of Patent: Sep. 30, 2003

(54) LIQUID DISCHARGE RECORDING HEAD, METHOD OF MANUFACTURE THEREFOR, AND LIQUID DISCHARGE RECORDING APPARATUS

(75) Inventors: Hiroki Tajima, Yokohama (JP); Yutaka Koizumi, Yokohama (JP); Yukuo Yamaguchi, Ohta-ku (JP); Mikiya Umeyama, Yokohama (JP); Nobuyuki Hatasa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/818,559

(22) Filed: Mar. 28, 2001

(65) Prior Publication Data

US 2001/0043247 A1 Nov. 22, 2001

(30) Foreign Application Priority Data

Mar. 31, 2000 (JP) ..... 2000-097619

(51) Int. Cl.[7] ..... B41J 2/135
(52) U.S. Cl. ..... 347/20
(58) Field of Search ..... 347/20, 65, 66, 347/87, 92

(56) References Cited

U.S. PATENT DOCUMENTS 4,703,332 A * 10/1987 Crotti et al. ..... 347/87
5,389,957 A 2/1995 Kimura et al. ..... 347/20
5,563,641 A * 10/1996 Plesinger ..... 347/47
5,701,148 A * 12/1997 Moynihan et al. ..... 347/92
5,736,998 A 4/1998 Caren et al. ..... 347/45
5,874,971 A * 2/1999 Nishioka et al. ..... 347/20
5,997,125 A 12/1999 Nishioka et al. ..... 347/20
6,155,677 A 12/2000 Kitani et al. ..... 347/65

* cited by examiner

*Primary Examiner*—Anh T.N. Vo
(74) *Attorney, Agent, or Firm*—Fitzpatrick, Cella, Harper & Scinto

(57) ABSTRACT

A liquid discharge recording head includes an orifice plate having a discharge port formed therefor to discharge liquid, and a main body portion having liquid flow paths formed therein to communicate with an opening arranged at an edge portion thereof, the discharge port and the opening being bonded to communicate with each other. A sealing groove is arranged on the circumference of the opening along the bonded face, and a filler is filled in the sealing groove. This makes it possible to pour filler into the sealing groove from the injecting groove after the orifice plate is bonded to the face having the opening formed therefor to communicate the opening with the discharge port of the orifice plate to eliminate any gaps from which the filler leaks between the orifice plate and the face having an opening formed therefor, and carry out sealing without clogging the circumference of opening or discharge port.

11 Claims, 6 Drawing Sheets

LIQUID DISCHARGE RECORDING HEAD, METHOD OF MANUFACTURE THEREFOR, AND LIQUID DISCHARGE RECORDING APPARATUS

BACKGROUND OF THE INVENTION

1. Field of the Invention

The present invention relates to a liquid discharge recording head for recording on a recording sheet by discharging liquid used for recording from an orifice (discharge port). The invention also relates to a method of manufacture therefor, as well as to a liquid discharge recording apparatus. The present invention is applicable to a copying machine, a facsimile equipment provided with communication systems, and an apparatus such as a word processor provided with a printing unit, besides a general printing apparatus.

In the specification hereof, the term "print" (which may be referred to as "record" in some cases) is understood to indicate not only the case where characters, graphics, or some other meaningful information is formed, but also, indicate the case where images, designs, patterns, or others are formed on a print medium irrespective of being meaningful or meaningless broadly or whether or not those are made apparent so as to be observable by human eyesight, or to indicate such a case that a medium is processed. Here, the term "print medium" means not only paper used for a printing apparatus in general, but also, means broadly cloths, plastics films, metallic plate, glass, ceramics, woods, leathers, or the like which is made capable of receiving ink. Further, the term "ink" (which may be referred to as "liquid" in some cases) should also be interpreted broadly as in the definition of "print" described above, and means the liquid with which to form images, designs, patterns or the like when it is provided for a print medium or for the medium that may be used for processing a print medium or processing ink (such as to coagulate colorant or make it insoluble in ink to be used for a print medium).

2. Related Background Art

The liquid discharge recording head comprises an element substrate having a plurality of discharge energy generating elements, such as electrothermal converting devices formed thereon, and a ceiling plate having on it a plurality of fine discharge ports and a plurality of liquid flow paths communicated therewith. The liquid discharge recording head is manufactured by assembling the element substrate and the ceiling plate in the state where each of the discharge energy generating elements and each of the liquid flow paths are positioned exactly. Then, the structure is arranged so that with electric energy applied to each of discharge energy generating elements, the change of states, which is followed by abrupt voluminal changes (creation of bubbles), is caused to occur on the liquid which is supplied from the outside and in contact with each of discharge energy generating elements, thus discharging liquid by the exertion of active force on the basis of such change of states of liquid for forming images on a recording medium by the adhesion of liquid thus discharged to it.

By adoption of the recording method that uses the liquid discharge recording head thus structured, images can be recorded in high quality at high speed with a lesser amount of noises, and at the same time, the discharge ports for discharging liquid can be arranged in high density with respect to the liquid discharge recording head that records using this recording method. Therefore, it has many advantages such as to obtain recorded images in high resolution even by use of a smaller apparatus, and also, obtain color images with ease, among some others. Thus, in recent years, this recording method is widely utilized for a printer, a copying machine, a facsimile device, and many other office equipment, and further, it is utilized even for textile printing systems, and others for industrial use.

However, the conventional grooved ceiling plate is formed by resin such as polysulfone on one hand, and the element substrate is formed by silicon on the other. Therefore, even if discharge energy generating elements and the grooves of liquid flow paths are positioned exactly at the time of manufacture, there are some cases where the positions of discharge energy generating elements and the grooves of liquid flow paths are caused to deviate later due to the difference in thermal expansion ratios influenced by the temperature changes under the environments of various uses, simply because materials used for both of them are different.

In order to avoid the positional deviation between the discharge energy generating elements and the grooves of liquid flow paths owing to the different materials used for the grooved ceiling plate and the element substrate, it is conceivable to form the grooved ceiling plate and the element substrate by use of the same material. In this case, the material of grooved ceiling plate should be arranged to be identical to that of element substrate. However, it is expected that this arrangement makes the integrated formation difficult for the orifice plate and the grooved ceiling plate in some cases. In other words, the orifice plate should be made in the form of thin and long plate without any warping, which should be provided with fine discharge ports formed thereon. It is not easy to produce a plate of the kind using silicon material. Here, therefore, it is conceivable to arrange the structure in which the orifice plate is prepared separately from the grooved ceiling plate, and after the grooved ceiling plate and element substrate, both of which are formed with the same material, are bonded together, the orifice plate individually formed by the material suitable for the formation of orifice plate is bonded to the already bonded face of the grooved ceiling plate and element substrate on liquid discharging side.

Conceivably, however, the liquid discharge recording head thus structured as described above makes it extremely difficult to effectuate sealing after having positioned each of plural discharge ports formed on the orifice plate and each of liquid flow paths with respect to those liquid flow paths formed by bonding the element substrate and the grooved ceiling plate. In other words, filler should be injected as sealant between the orifice plate and the bonding face of the orifice plate having liquid flow paths formed therefor, but only around the discharge ports. For example, therefore, if sealing is not made sufficient due to a smaller amount of sealant thus filled, it is expected that liquid is allowed to leak from the bonded faces even to disable liquid discharges or, on the contrary, if filling agent is too much, a problem may be encountered that the discharge ports are clogged.

SUMMARY OF THE INVENTION

The main object of the present invention is to provide a liquid discharge recording head capable of sealing the circumference of discharge ports without clogging the discharge ports or liquid flow paths, and also to provide a method of manufacture therefor, as well as a liquid discharge recording apparatus.

The liquid discharge recording head of the present invention comprises an orifice plate having discharge ports formed therefor to discharge liquid, and the main body portion having liquid flow paths formed therein to be communicated with an opening arranged at the edge portion thereof, the discharge ports and the opening being bonded to communicate with each other. For this liquid discharge recording head, a sealing groove is arranged on the circumference of the opening along the bonded face, and filler is filled in the sealing groove. Also, the method of the present invention for manufacturing a liquid discharge recording head comprises the steps of bonding an orifice plate having discharge ports to discharge liquid formed therefor to the main body portion having liquid flow paths therein to be communicated with opening arranged on the edge portion and provided with a sealing groove on the circumference of the opening, so as to enable the discharge ports and the opening to be bonded and communicated with each other; and filling filler into the sealing groove. Further, the liquid discharge recording apparatus of the present invention comprises a liquid discharge recording head of the invention described above, and a member for mounting the liquid discharge recording head.

For such typical embodiments of the present invention, the sealing groove is formed to surround the element substrate and the grooved ceiling plate, that is, to surround the face having the opening of liquid flow paths formed therefor. The face other than the one having the sealing groove formed therefor is provided with the injecting groove for use of filling filler formed to be communicated with the sealing groove. As a result, it becomes possible to pour filler into the sealing groove from the injecting groove after the orifice plate is bonded to the face having the opening formed therefor to communicate the opening with the discharge ports of orifice plate so as to eliminate any gaps from which filler leaks between the orifice plate and the face having opening formed therefor. Thus, it is made possible to carry out sealing by distributing filler over the entire area of sealing groove in an amount required for sealing appropriately without clogging the circumference of openings or discharge ports.

Here, it may be possible to form the edge portion of injecting groove in a position on the face other than the one where the sealing groove is arranged, but not covered by the fixing margin of orifice plate which is used for fixing it to the main body portion. In this case, the edge portion of injecting groove, that is, the injecting port of injecting groove for injecting filler, is not concealed even if the fixing margin of orifice plate is fixed to the main body portion. Therefore, it becomes possible to execute the filling of filler after the fixing margin of orifice plate is fixed to the main body portion.

The face where the opening is formed may be extruded from the face of liquid supply member on the side where the sealing groove is formed. In this case, the orifice plate is pressed to the face having the opening is formed therefor, thus making it possible to prevent further any gap from being formed to allow filler to leak between the orifice plate and the face having the opening formed therefor.

The dimension of sealing groove may be the one that makes filler flowable by means of capillary force. In this case, the filler can be poured into the sealing groove without any external force exerted to enable the filler to flow after it has been injected from the injecting groove, and distribute it over the entire area in the sealing groove.

In accordance with the present invention, it becomes possible to provide a liquid discharge recording head capable of sealing the circumference of discharge ports reliably without allowing filler to clog discharge ports or liquid flow paths, and also, to provide the method of manufacture therefor, and liquid discharge recording apparatus as well.

DETAILED DESCRIPTION OF THE PREFERRED EMBODIMENTS

Hereinafter, with reference to the accompanying drawings, the description will be made of the embodiment in accordance with the present invention.

Figure 1:
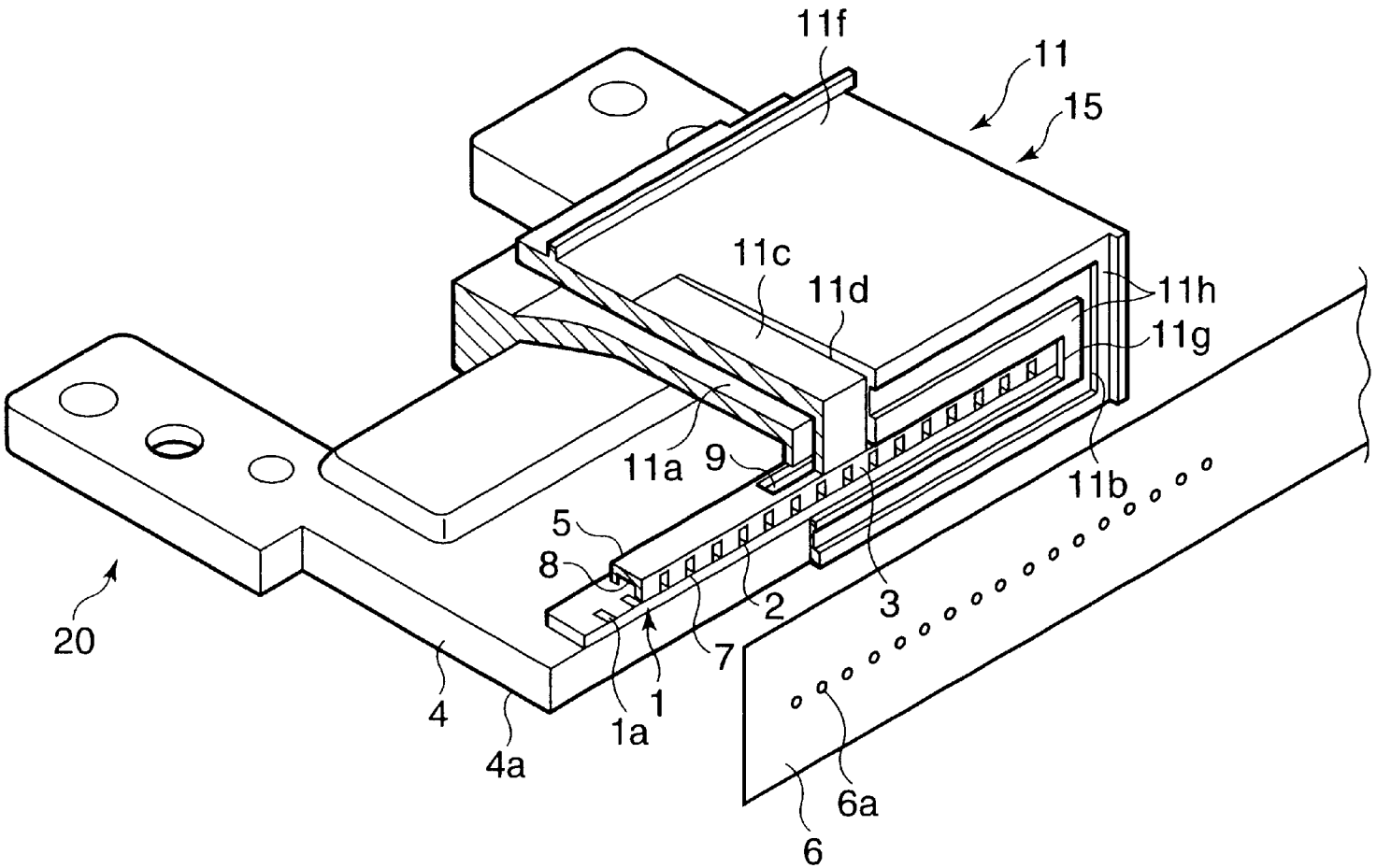
FIG. 1 is a partially broken perspective view which shows the liquid discharge recording head in accordance with one embodiment of the present invention before the orifice plate is bonded.

FIG. 1 is a partially broken perspective view which shows the liquid discharge recording head in accordance with one embodiment of the present invention before the orifice plate is bonded. Also, FIG. 2 is a perspective view which illustrates the positional relations between the edge portion of the orifice plate, and the injection part where filler is injected.

The liquid discharge recording head 15 comprises the element substrate 1 formed by silicon base plate where the base plate 4 and a plurality of energy generating elements la arranged on the base plate 4; the grooved ceiling plate 5 of the same material as the element substrate 1, for which a plurality of grooves 7 are formed to become the liquid flow paths each of which corresponds to each of the energy generating elements 1*a*; the main body portion 20 provided with the chip tank 11 having the liquid supply path 11*a* communicated with the liquid supply hole 9 of the grooved ceiling plate 5, and the sealing groove 11*b* where filler is filled; and the orifice plate 6 having a plurality of discharge ports 6*a* formed for discharging liquid.

Figure 2:
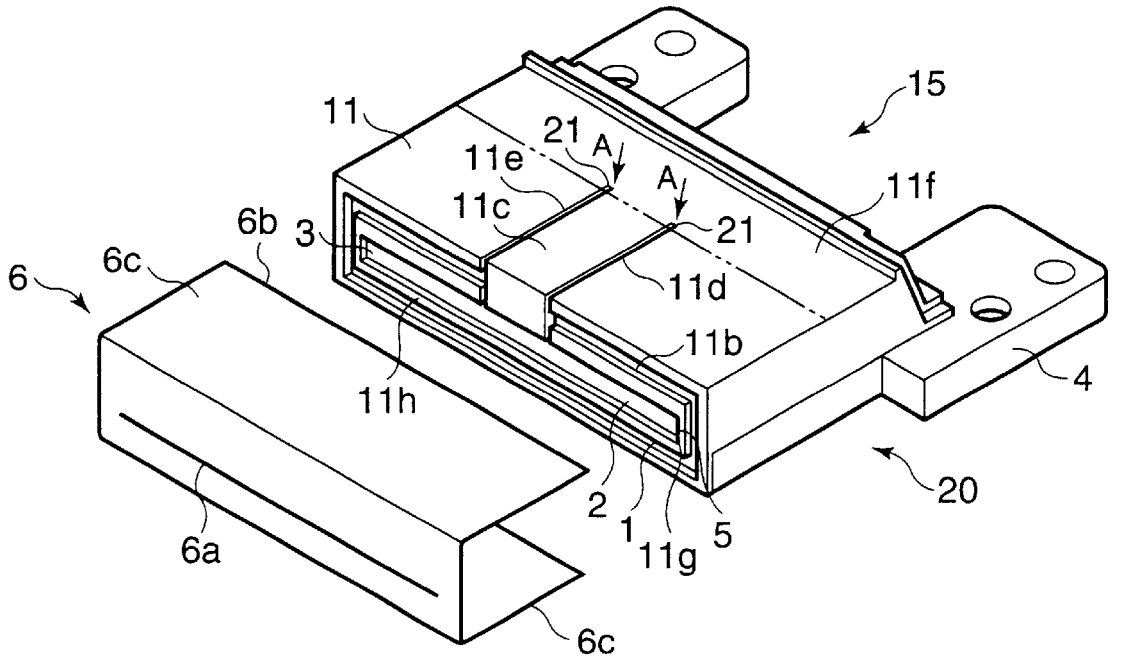
FIG. 2 is a perspective view which illustrates the positional relations between the edge portion of the orifice plate, and the injection part where filler is injected.

In this respect, the orifice plate 6 is not only configured as shown in FIG. 1, but may be configured as shown in FIG. 2 to be folded to provide fixing margins 6*c* whereby to fix the orifice plate on the upper face 11*f* of chip tank 11 and the lower face 4*a* of base plate 4.

Each energy generating element 1*a* formed on the element substrate 1 is an electrothermal converting device, and heated with the provision of electric signals from control circuits (not shown) through a flexible cable (not shown). Also, the element substrate 1 is bonded and fixed onto the base plate 4 using bonding agent or the like.

The liquid supply hole 9, the common liquid chamber 8, and each of grooves 7, which are formed on the grooved ceiling plate 5 by the photolithographic process or the like, are communicated, and the grooved ceiling plate 5 is bonded to the element substrate 1 so that each of grooves 7 and each of the energy generating elements 1*a* are bonded, thus forming liquid flow paths having energy generating elements 1*a* correspondingly. The flow path opening edge 2 of each flow path is formed on the flow path edge face 3 that faces the orifice plate 6.

For the chip tank 11, there is formed the liquid supply passage 11*a* through which liquid is supplied from the ink tank (not shown) that contains liquid, such as ink, in the interior thereof to the liquid supply hole 9 of grooved ceiling plate 5. The liquid supply portion 11*c* of the chip tank 11 where the liquid supply passage 11*a* is formed presses down the element substrate 1 and the grooved ceiling plate 5 and fix them to the base plate 4. This pressure may be exerted by arranging a structure in the form of cantilever having the portion where the liquid supply portion 11*c* abuts against the element substrate 1 and the groove ceiling plate 5 as functioning point or may be exerted by use of elastic member such as spring. In this respect, for the front face 11*h*, the opening 11*g* is formed to enable the liquid flow edge face 3 to be exposed. The flow path edge face 3 may be extruded from the front face 11*h*. In this case, the orifice plate 6 is pressed to the flow path edge face 3. Therefore, it becomes possible to prevent more the formation of any gap between the orifice plate 6 and the flow path edge face 3 from which filler is allowed to leak.

Also, for the upper face 11*f* of chip tank 11, the first slit 11*d* and second slit 11*e* (see FIG. 2), which are grooves for use of filler injection, are formed for injecting filler after the orifice plate 6 is bonded to the flow path edge face 3 to be described later. Also, for the front face 11*h*, a sealing groove 11*b* is formed to be communicated with the first and second slits 11*d* and 11*e*, and to surround all the flow paths, that is, to surround the opening 11*g*. The first and second slits 11*d* and 11*e*, and the sealing groove 11*b* are formed each by a dimension so as to allow filler to be filled by the flow that occurs due to capillary force. Also, as shown in FIG. 2, the injecting sections 21 of the first and second silts 11*d* and 11*e*, through which filler is injected, is formed on the location where the edge portion 6*b* of fixing margin 6*c* of orifice plate 6 is exposed even if this edge portion is positioned at the place indicated by two-dot chain line in FIG. 2 when the orifice plate 6 of such a type as being folded for fixation is fixed to the chip tank 11.

The orifice plate 6 is bonded and fixed to the flow path edge face 3 by use of bonding agent or the like so that each of discharge ports 6*a* faces each of the flow path opening 2, respectively. If the shape of the orifice plate 6 is such that it has fixing margins 6*c* as shown in FIG. 2, the other faces of the orifice plate 6 than the one that faces the front face 11*h* are folded to the upper face 11*f* side of chip tank 11, and the lower face 4*a* side of base plate 4, and then, fixed to each of these faces. The fixing margin 6*c* of orifice plate 6 may be fixed to the chip tank 11 mechanically, not necessarily by means of bonding agent or the like.

Now, the description will be made of the liquid discharges of the liquid discharge recording head 15 structured as described above. Liquid, such as ink, supplied from the ink tank is supplied to the common liquid chamber 8 by way of the liquid supply hole 9 through the liquid supply passage 11*a*. After that, liquid flows into each of the flow paths. Then, in this condition, each of the energy generating elements 1*a* is heated when electric signals are given by use of the control circuits. Thus, thermal energy is given to liquid, and liquid is discharged from discharge ports 6*a* as droplets by utilization of the bubbling pressure of bubbles created in liquid by change of phases (film boiling) of liquid at that time.

Next, with reference to FIGS. 3A to 3D and FIGS. 4A to 4D, the description will be made of bonding of the orifice plate to the chip tank, as well as filling of the filler, in particular, among the manufacturing processes of the liquid discharge recording head. In this respect, FIGS. 3A to 3D and FIGS. 4A to 4D schematically illustrate the chip tank 11, the element substrate 1, the grooved ceiling plate 5, and the base plate 4 as the main body portion 20. Also, regarding slits, only the first slit 11 is shown and the second slit 11*e* is not represented in them.

Figure 3A:
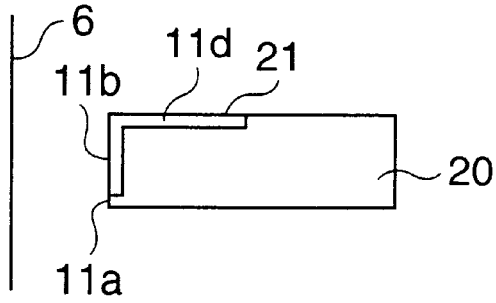
FIGS. 3A, 3B, 3C, and 3D are side views which illustrate bonding of the orifice plate to the chip tank, and filling of filler.

As shown in FIG. 3A, the orifice plate 6 is arranged at first to face the front face 11*h* of chip tank 11.

Figure 3B:
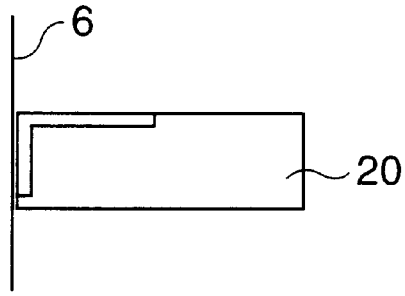

Then, as shown in FIG. 3B, each flow path opening 2 represented in FIG. 1 and each discharge port 6 of orifice plate are positioned to face each other, and the orifice plate 6 is bonded to the flow path edge face 3. In this manner, the orifice plate 6 and the flow path edge face 3 are conditioned to present no gap between them.

Figure 3C:
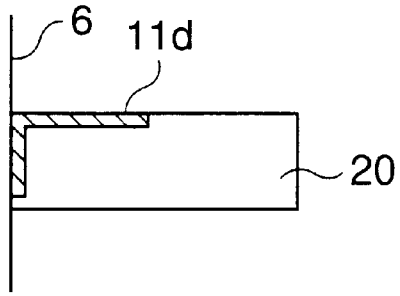

Next, as shown in FIG. 3C, filler is injected through the first slit 11*d*. At this juncture, the location of injection may be the injecting portion 21, but the location is not necessarily limited thereto. Any location on the first slit 11*d* will do if only filler can be injected. Here, filler may be injected through the second slit 11*e* or may be injected through both first and second slits 11*d* and 11*e* simultaneously. After flowing into the sealing groove 11*b*, the filler thus filled is distributed by capillary force to the entire area in the sealing groove 11*b* which is formed to surround the circumference of flow path opening 2. Here, the depth of sealing groove 11*b* is 1 mm and the width is 1 mm. As the material of filler, it is preferable to use the one the sealing performance of which is not lowered for a long time even if it is in contact with liquid such as ink or can hardly be lowered. For such material, there is silicon sealant, for example.

Figure 3D:
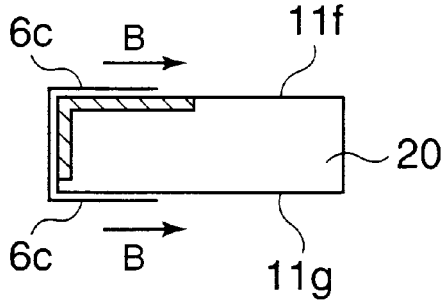

Next, as shown in FIG. 3D, the fixing margins 6*c* of orifice plate 6 are folded to the upper face 11*f* side of chip tank 11, and to the lower face 4*a* side of base plate 4, and fixed to them, respectively. Here, now that the leakage of liquid from the gap between the front face 11*h* of chip tank 11 and the orifice plate 6 is prevented by the filler which is filled into the sealing groove 11*b*, it may be possible to effectuate the fixation mechanically as described above, but not using bonding agent or the like. In this case, the orifice plate 6 may be fixed while being tensioned in the direction indicated by an arrow B.

So far, in conjunction with FIGS. 3A to 3D, the description has been made of bonding the orifice plate 6 to the chip tank 11, and also, of filling the filler for such a method of manufacture that the filling of filler is executed before the orifice plate 6 is folded. However, as shown in FIGS. 4A to 4D, it may be possible to fill the filler after the orifice plate 6 is folded.

Figure 4A:
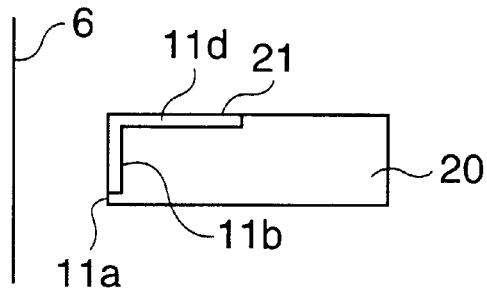
FIGS. 4A, 4B, 4C, and 4D are side views which illustrate bonding of the orifice plate to the chip tank, and filling of filler.
Figure 4B:
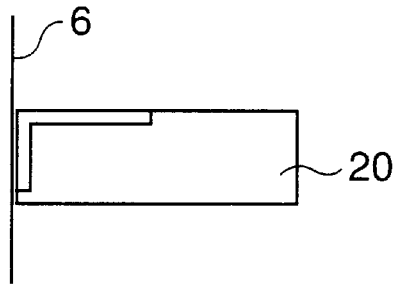

In other words, as shown in FIG. 4A, the orifice plate 6 is at first arranged to face the front face 11*h* of chip tank 11, and as shown in FIG. 4B, the orifice plate 6 is bonded to the flow path edge face 3.

Figure 4C:
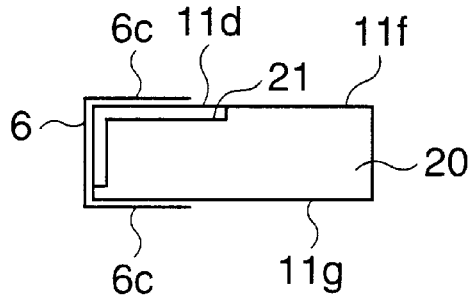

Then, as shown in FIG. 4C, the orifice plate 6 is bonded to fix the fixing margins 6*c* to the upper face 11*f* of chip tank 11 and the lower face 4*a* of base plate 4, respectively. In this state, the injecting portion 21 of the first silt 11*d* and the second slit 11*e* are not covered by the folded orifice plate 6, but exposed.

Figure 4D:
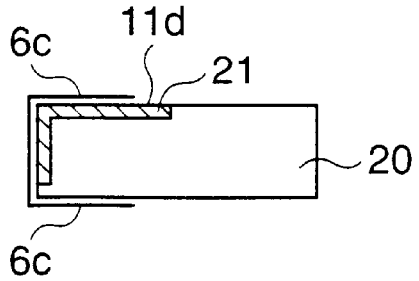

Next, as shown in FIG. 4D, filler is injected through the exposed injecting portion 21. In this manner, the filler is distributed by capillary force to the entire area of sealing portion 11*b*, and seals the gap between the orifice plate 6 and the front face 11*h* of chip tank 11.

As described above, in accordance with the liquid discharge recording head of the present embodiment, each of the flow path openings 2 and each of the discharge ports 6*a* of orifice plate 6 are positioned exactly, and the filler which is used for preventing liquid leakage is filled from the gap between the orifice plate 6 and the front face 11*h* after the orifice plate 6 is bonded to the flow path edge face 3. In other words, the filler is poured into the sealing groove 6*b* after it is arranged not to form any gap where the filler is allowed to flow between the orifice plate 6 and the flow path openings 2 by bonding the orifice plate 6 to the flow path edge face 3. As a result, there is no possibility that the filler which is poured into the sealing groove 6*b* is allowed to overflow into the flow path edge face 3, and clog any one of the flow path openings 2. Also, it becomes possible to fill a desired amount of filler needed to seal so as not to cause any leakage of liquid that may take place if the filling amount of filler is made smaller with the anxiety that the clogging of the flow path openings 2 should be avoided.

Figure 5:
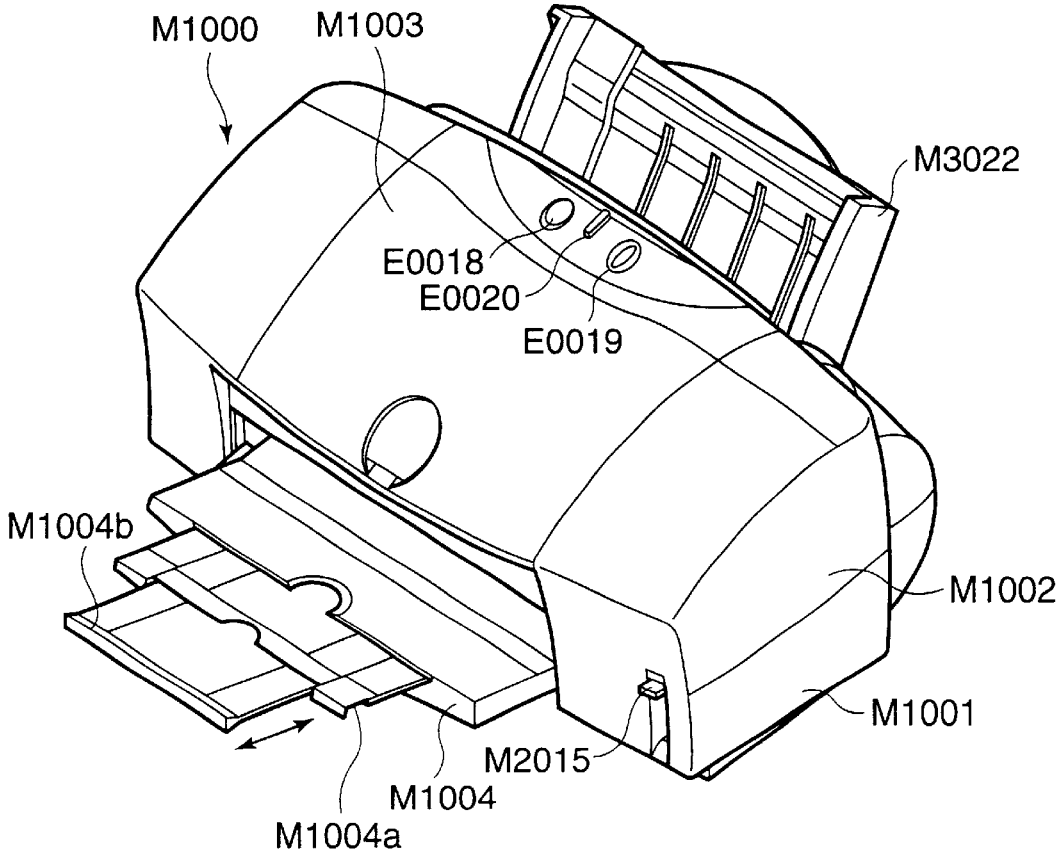
FIG. 5 is a perspective view which shows the outer appearance of the liquid discharge recording apparatus in accordance with the present invention.
Figure 6:
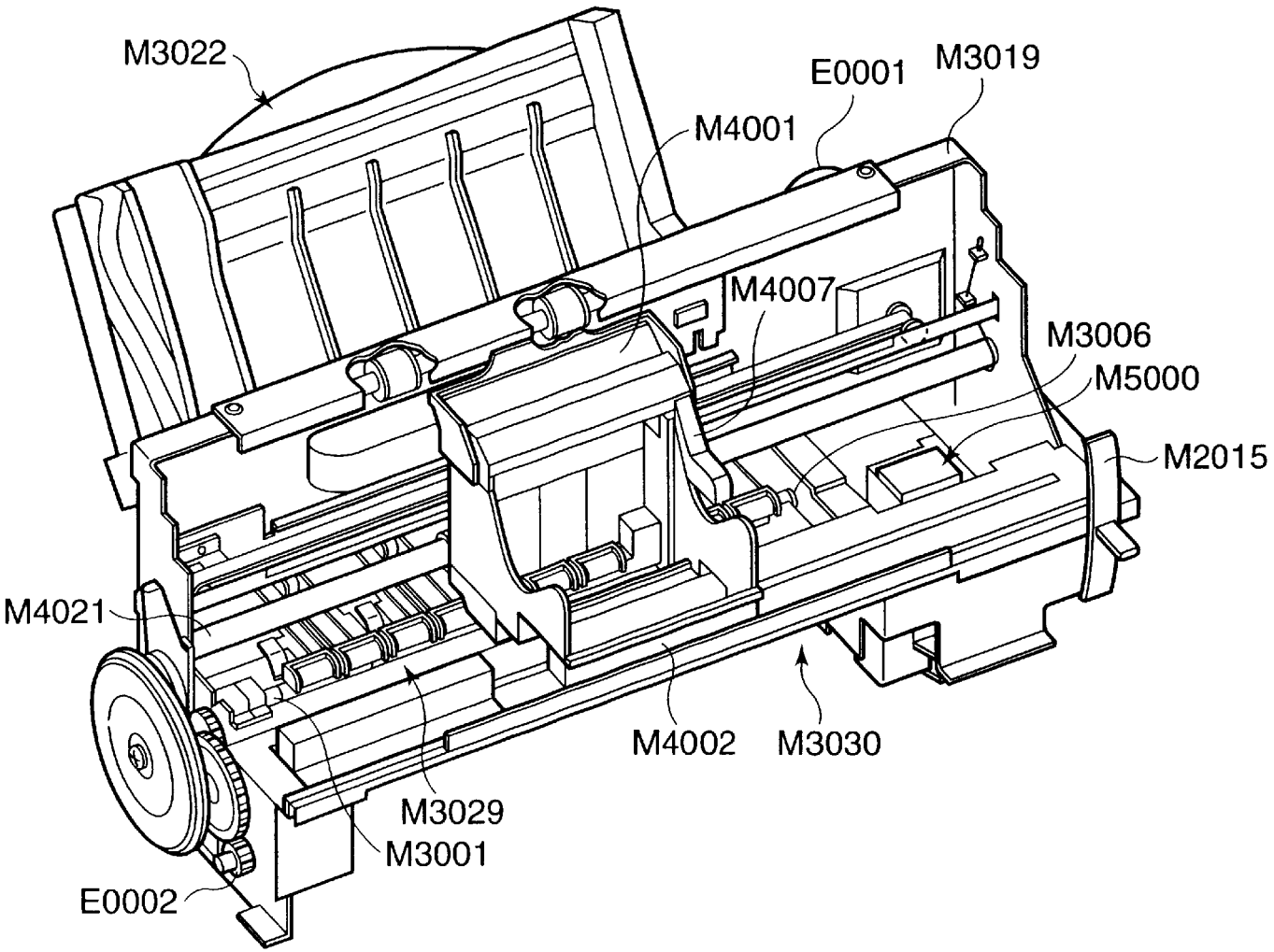
FIG. 6 is a perspective view which shows the principal part of the liquid discharge recording apparatus in accordance with the present invention.

FIG. 5 and FIG. 6 are views which schematically illustrate the printer that used ink jet recording method.

In FIG. 5, the apparatus main body M1000 that forms the outer frame of printer of the present embodiment comprises a lower case M1001; an upper case M1002; an access cover M1003; and the external member of outlet tray M1004 and the chassis M3019 (see FIG. 6) housed in the external member thereof.

The chassis M3019 is structured by a plurality of metallic plate members having a designated robustness, and forms the skeleton of the recording apparatus so as to hold each of recording operation mechanisms to be described later.

Also, the lower case M1001 forms substantially the lower half of the apparatus main body M1000, and the upper case M1002 forms substantially the upper half of the apparatus main body M1000, respectively, and when both cases are assembled, a hollow structure formed with a housing space to contain therein each mechanism to be described later. On the upper face portion and front face portion thereof, each of the openings is formed, respectively.

Further, On end of outlet tray M1004 is rotatively held by the lower case M1001, and by the rotation thereof, it is made possible to rotate the opening formed on the front face portion of lower case M1001 to be opened or closed. Therefore, when recording operation is carried out, the outlet tray M1004 is rotated toward the front face side so as to make the opening portion ready to serve. Then, each of the recorded sheets is expelled from that portion, and at the same time, each recording sheet P thus expelled is stacked one after another. Also, In the outlet tray M1004, two auxiliary trays M1004*a* and M1004*b* are housed, and each tray is drawn out forwardly as needed to enlarge or reduce the supporting area in three steps for each of the recording sheets accordingly.

One end of the access cover M1003 is rotatively supported by the upper case M1002 to make it possible to open or close the opening portion formed on the upper face. With the access cover M1003 being open, it becomes possible to exchange recording cartridges H1000 or ink tanks H1900 housed in the interior of main body. In this respect, although not particularly shown, it is arranged so that when the access cover M1003 is opened or closed, the extrusion formed on the reverse side thereof enables the cover open and close lever to be rotated, and that the rotated position of the lever is sensed by a microswitch in order to detect the open or closed condition of access cover.

Also, on the rear upper face of the upper case M1002, the power-supply key E0018 and the resume key E0019 are arranged to be depressible, and at the same time, an LED E0020 is arranged. When the power-supply key is depressed, the LED E0020 is illuminated to inform the operator that recording is ready. Also, the LED E0020 is provided with various functions of indication, such as to inform the operation of printer trouble or the like by changing the way of illumination or illuminated colors or a buzzer E0021 is sounded. In this respect, the structure is arranged so that when trouble or the like is resolved, recording can be resumed by depressing the resume key E0019.

Now, the description will be made of the mechanisms of recording operation provided for and held in the aforesaid printing apparatus main body M1000. As the mechanisms of the present embodiment, there are provided the automatic sheet feeding unit M3022 that automatically feeds a recording sheet P into the apparatus main body; the carrier unit M3029 that carries the recording sheet P which is fed out from the automatic feeding unit one by one to the desired recording position, and at the same time, carries the recording sheet P to the sheet expelling unit M3030 from the recording position; and the recording unit to perform a desired recording on the recording sheet P carried to the carrier unit M3029, and the recovery unit (M5000) that performs recovery process for the aforesaid recording unit or the like. The recording unit comprises the carriage M4001 movably supported by a carriage shaft M4021; and the recording head cartridge H1000 which is detachably mounted on the carriage M4001.

What is claimed is:

1. A liquid discharge recording head, comprising:

an orifice plate having a discharge port formed therefor to discharge liquid; and a main body portion having liquid flow paths formed therein to communicate with an opening arranged at an edge portion thereof, said orifice plate being bonded to said main body portion so that said discharge port and said opening communicate with each other, wherein a sealing groove is arranged on the circumference of said opening, and a filler is filled in said sealing groove, wherein said main body portion comprises:

an element substrate having a plurality of energy generating elements formed thereon for generating energy to be utilized for discharging liquid from said discharge port, a grooved ceiling plate having a plurality of grooves formed thereon to become said liquid flow paths facing said energy generating elements when being bonded to said element substrate, and a liquid supply member for supplying liquid to said liquid flow paths, wherein said sealing groove is provided for said liquid supply member to surround said element substrate and said grooved ceiling plate, and an injection groove is provided for said sealing groove to inject filler to faces other than the edge portion having said sealing groove formed therein, wherein said orifice plate is provided integrally with fixing margins to fix said orifice plate to said main body portion by use of faces other than the edge portion having said sealing groove formed therein, and wherein an edge portion of said injection groove is arranged on a position not to be covered by said fixing margins of said orifice plate.

2. A liquid discharge recording head according to claim 1, wherein said liquid supply member is provided with a liquid supply portion for supplying liquid to said liquid flow paths through said grooved ceiling plate, and said liquid supply portion is provided with a structure for pressing down said grooved ceiling plate to said element substrate.

3. A liquid discharge recording head according to claim 2, wherein said structure provided for said liquid supply portion is a structure in a cantilever fashion.

4. A liquid discharge recording head according to claim 1, wherein the face having said opening arranged therefor is extruded from the face of said liquid supply member on the side having said sealing groove arranged therefor.

5. A liquid discharge recording head according to claim 1, wherein the dimension of said sealing groove is a dimension making said filler flowable by capillary force.

6. A liquid discharge recording head according to claim 1, wherein said energy generating elements are electrothermal converting devices for generating thermal energy utilized for discharging liquid from said discharge port.

7. A liquid discharge recording apparatus comprising:

a liquid discharge recording head according to claim 1; and a member for mounting said liquid discharge recording head.

8. A method for manufacturing a liquid discharge recording head, comprising the steps of:

bonding an orifice plate, having a discharge port to discharge liquid, to a main body portion having liquid flow paths therein which communicate with an opening arranged on an edge portion and provided with a sealing groove on the circumference of said opening, so as to enable said discharge port and said opening to communicate with each other;

filling a filler into said sealing groove, wherein said main body portion comprises an element substrate having a plurality of energy generating elements formed thereon for generating energy to be utilized for discharging liquid from said discharge port, a grooved ceiling plate having a plurality of grooves formed thereon to become said liquid flow paths facing said energy generating elements when being bonded to said element substrate, and a liquid supply member for supplying liquid to said liquid flow paths, wherein said sealing groove is provided for said liquid supply member to surround said element substrate and said grooved ceiling plate, and an injection groove is provided for said sealing groove to inject filler to faces other than the edge portion having said sealing groove formed therein, wherein said orifice plate is provided integrally with fixing margins for contacting said orifice plate, said method further comprising the step of fixing said fixing margins to said main body portion by use of faces other than the the edge portion having said sealing groove formed therein, and wherein an edge portion of said injection groove is arranged on a position not to be covered by said fixing margins of said orifice plate.

9. A method for manufacturing a liquid discharge recording head according to claim 8, wherein said fixing step is executed after said filling step.

10. A method for manufacturing a liquid discharge recording head according to claim 8, wherein said fixing step is executed after said bonding step but before said filling step.

11. A method for manufacturing a liquid discharge recording head according to claim 8, where said filler flows in said sealing groove by capillary force in said filling step.

* * * * *